United States Patent [19]

Sapp

[11] Patent Number: 4,915,379

[45] Date of Patent: Apr. 10, 1990

[54] APPARATUS FOR EXERCISE AND PHYSICAL THERAPY

[76] Inventor: William E. Sapp, Rte. 5, Box 39 B, Riverside, Wash. 98849

[21] Appl. No.: 222,721

[22] Filed: Jul. 21, 1988

[51] Int. Cl.[4] ..... A63B 21/00

[52] U.S. Cl. ..... 272/134; 272/130; 272/136

[58] Field of Search ..... 272/130, 134, 136, 144, 272/137, 116, 118, 126

[56] References Cited

U.S. PATENT DOCUMENTS

| | | | |
|---|---|---|---|
| 3,822,599 | 7/1974 | Brentham | 272/130 X |
| 4,211,403 | 7/1980 | Coffaro et al. | 272/134 |
| 4,257,593 | 3/1981 | Keiser | 272/130 |
| 4,606,541 | 8/1986 | Kirkpatrick | 272/136 |
| 4,645,205 | 2/1987 | Wolff | 272/130 X |
| 4,763,897 | 8/1988 | Yakata | 272/134 X |
| 4,786,051 | 11/1989 | Mullican | 272/144 X |

*Primary Examiner*—Richard J. Apley
*Assistant Examiner*—H. Flaxman
*Attorney, Agent, or Firm*—Keith S. Bergman

[57] ABSTRACT

The disclosed apparatus provides a base supporting at one end an upstanding mast pivotally mounting a boom in the upper portion of the mast to extend over the base. A bench to support a user is supported by the base spacedly thereabove and below the boom. A handle assembly is pivotally carried by the boom end extending over the base to depend spacedly above the base. A hydraulic cylinder communicates between the boom and the base to resist pivotal motion of the boom responsive to exercise motion of the handle assembly by a user supported on the bench. A resistance assembly provides spaced grips carried by a pull shaft for longitudinal motion toward and away from the bench end distal from the mast. The pull shaft end proximate the mast communicates by cable supported on pulleys to the boom end distal from the handle assembly so that the boom resists motion of the resistance assembly grips responsive to exercise motion thereof by a user supported on the bench. A self-contained electrically powered hydraulic system operates the hydraulic cylinder and provides an adjustment mechanism to determine resistive force of the boom and switch structure to determine operation of the system.

8 Claims, 4 Drawing Sheets

APPARATUS FOR EXERCISE AND PHYSICAL THERAPY

FIELD OF THE INVENTION.

This invention relates to the field of exercising and physical therapy machines.

BACKGROUND OF THE INVENTION.

There are numerous types of exercise machines and apparatus for use by individuals who wish to improve their overall physical fitness and strength. Many of the same machines are also used in the medical profession for physical therapy for patients recovering from injury or sickness.

One of the most popular apparatus is free weights which are attached to a bar and lifted in various ways by the person exercising. A disadvantage of free weights is that it can be dangerous to attempt lifting a heavy weight without the use of "spotters". When a person is lifting a heavy weight, "spotters" are required to prevent loss of control of the weight when it is overhead. Without "spotters", the weight can fall causing damage to the exercise area or physical injury to the lifter.

Another type of existing machine exerts a continuous pressure against a range of motion through which the user moves various parts of his body. The disadvantage of this type of machine is the need for many different machines to go through a range of exercises. In addition, these machines do not give the user the "feel" of free weights.

A third type of existing machine is the universal gym type. this type of machine has the same disadvantage as free weights, in that the user can lose control of and drop the weight if he becomes fatigued, causing damage to the machine or injury to himself.

It is desirable in an exercise machine to combine the "feel" of free weights with a safety feature allowing use without "spotters". It would also be desirable to have a machine with an easily adjustable "weight" or pressure to operate.

BRIEF DESCRIPTION OF THE DRAWINGS.

The preferred embodiment of the invention is shown in the accompanying drawings, in which.

Figures 1, 3:
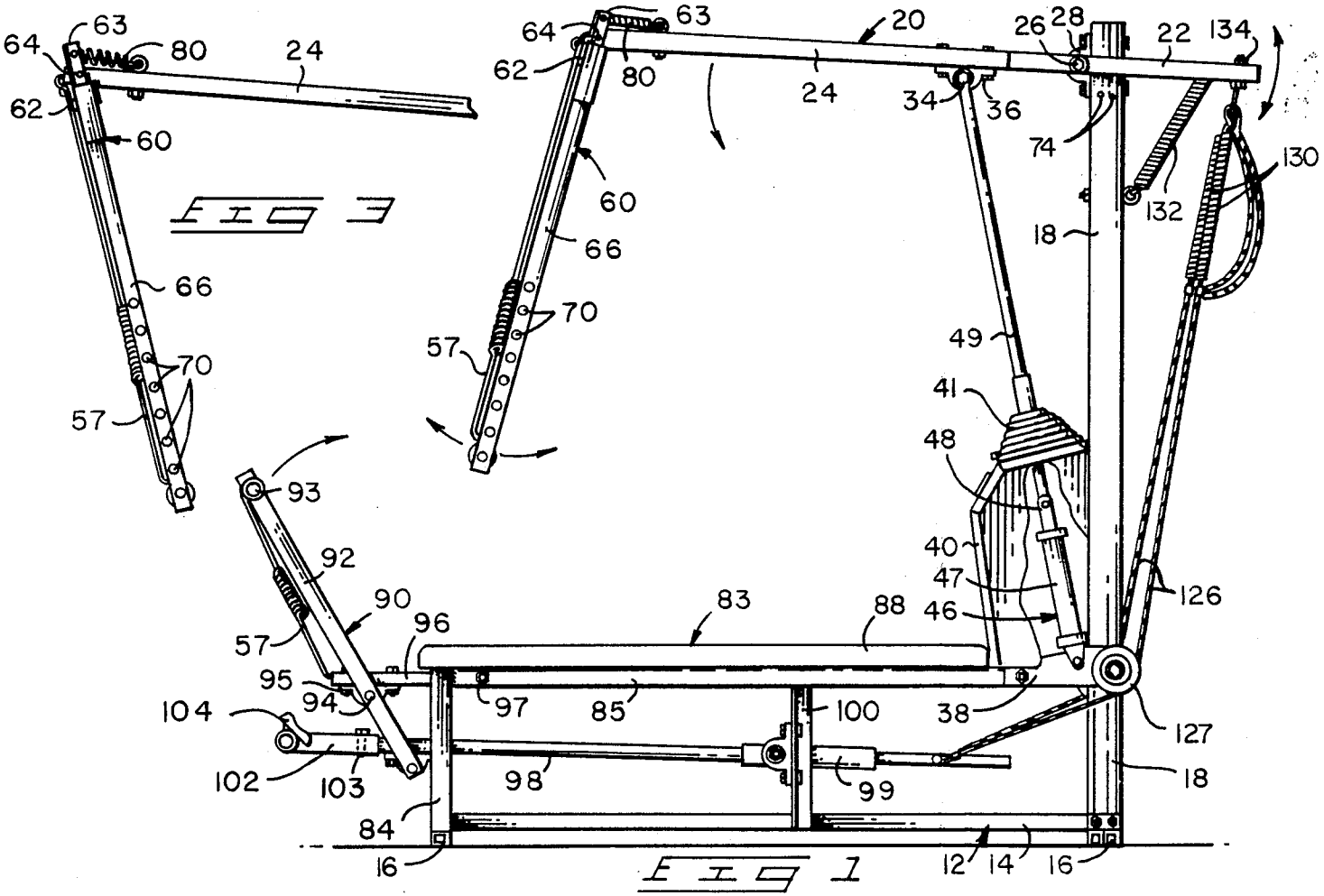
FIG. 1 is a side elevational view of the invention.
FIG. 3 is a partial side elevational view of the invention showing the boom assembly and handle assembly.

BRIEF DESCRIPTION OF THE PREFERRED EMBODIMENT.

The present invention, shown in the accompanying drawings and generally referred to therein by the reference numeral 10 provides an alternate apparatus to those described above for physical exercise.

It provides a combination weight lifting and resistance machine in one compact, lightweight and inexpensive unit. It also provides the "feel" of free weights, while eliminating the possibility of lose of control when the apparatus is being used. The resistance is easily changed over a wide range for use by people with widely varying strength.

With the present invention, simply by adjusting hydraulic pressure the apparent "weight" can be increased to the maximum practical weight which could be lifted by the user. This is accomplished without any increase in the weight of the invention, which can be under 100 pounds total.

Figure 2:
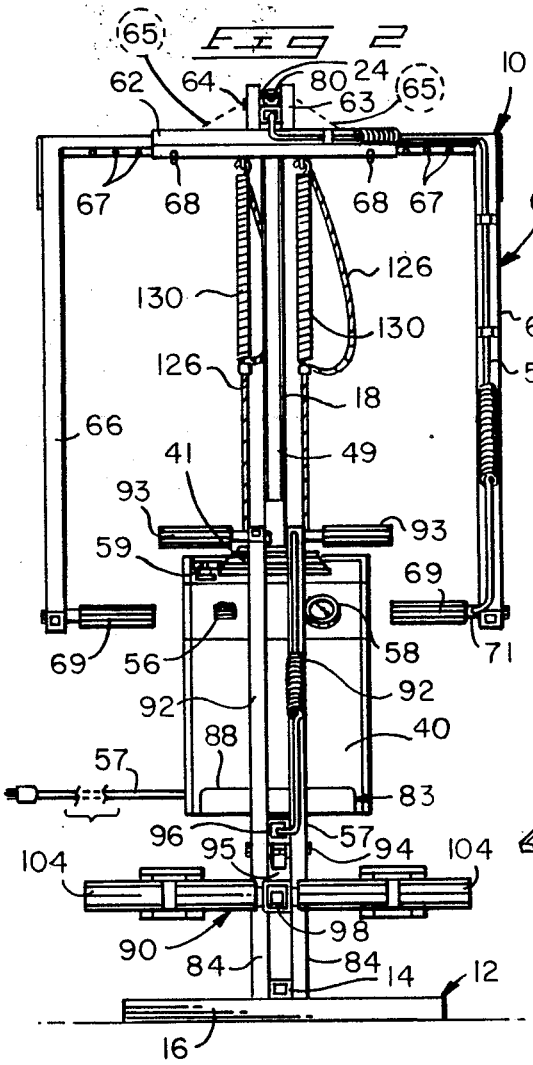
FIG. 2 is a front elevational view of the invention.

The apparatus 10 is generally shown in FIGS. 1 and 2. It has a base assembly 12 which is adapted to rest on a floor or other such surface. The base assembly 12 has a longitudinal base member 14. Attached adjacent each end of the base member 14 are support feet 16. Support feet 16 extend outwardly on either side of base member 14 and provide a stable support platform for the apparatus 10.

As shown in FIG. 2, an upright mast 18 extends upwardly from the base assembly 12. The mast 18 is rigidly attached at its lower end to the base assembly 12. In the preferred embodiment, the mast 18 is a hollow rectangular metal member, giving it strength, but limiting its weight. In the preferred embodiment, the longitudinal axis of both the base member 14 and the mast 18 are in the same plane.

A boom assembly 20 is pivotally attached to mast 18 adjacent the upper end of mast 18. The boom assembly 20 includes a pair of parallel pivot arms 22 spaced apart from one another and positioned on opposite sides of mast 18. The boom assembly also has a boom 24 which is rigidly attached to the end of pivot arms 22.

The pivot arms 22 are pivotally attached to the mast 18 by a pivot bolt 26 and pivot arm support bracket 28. The pivot bolt 26 extends through both pivot arms 22 and bracket 28. The pivot bolt 26 allows the boom assembly 20 to pivot about the longitudinal axis of pivot bolt 26, which is perpendicular to the plane containing the longitudinal axis of mast 18 and base member 14.

The present invention also has a variable pressure means attached between the boom 24 and the mast 18. The variable pressure means exerts a continual force on the boom 24 in the direction of the base assembly 12.

Figure 10:
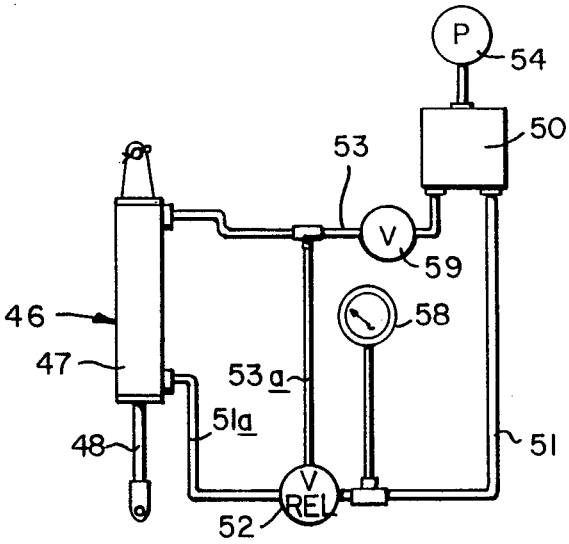
FIG. 10 is a schematic view of the hydraulic system of the invention.

In the preferred embodiment, the variable pressure means is a conventional pump driven dual action hydraulic cylinder 46 operated in a single action pull mode, as shown in FIGS. 1 and 10. The hydraulic apparatus is shown in schematic style in FIG. 10.

Figure 7:
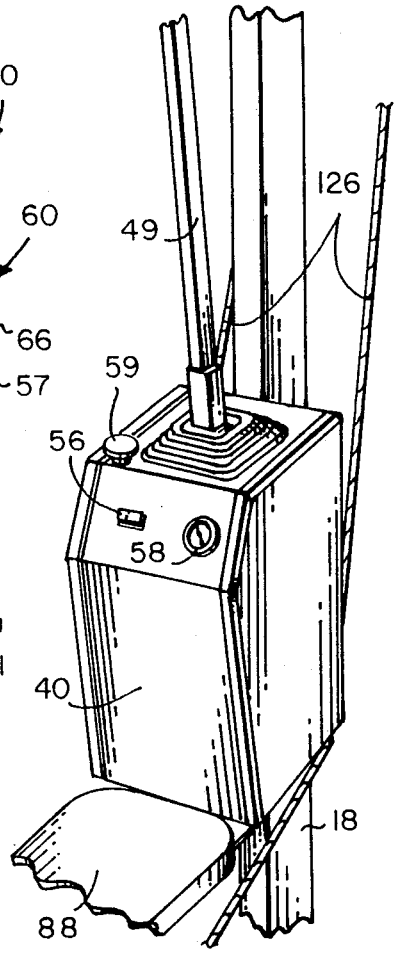
FIG. 7 is a partial isometric view of the invention showing a portion of the hydraulic case and control panel.
Figure 8:
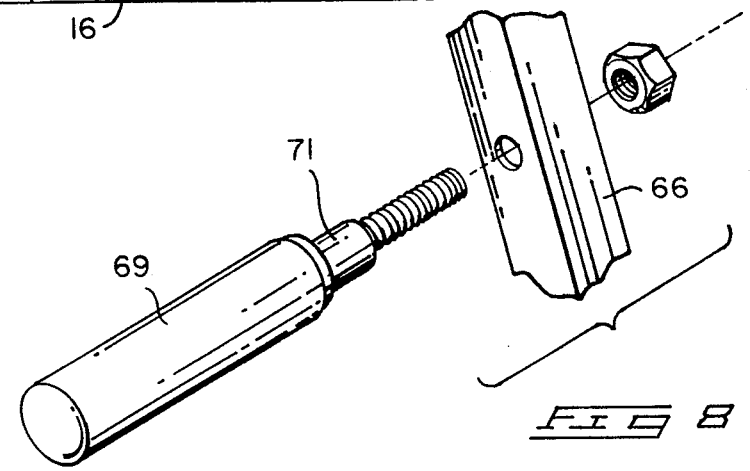
FIG. 8 is an exploded view of one of the exercising machine handle grips.

The hydraulic system is contained in a case 40, shown in FIG. 7. The case 40 has a rubberized boot 41 to keep dirt and other impurities out of the interior of the case 40. The case 40 and boot 41 also protect against a person's clothing or limbs being caught and injured by moving parts of the apparatus.

In the preferred embodiment, the cylinder 46 has an outer body 47 enclosing a moveable piston (not shown) attached to a piston rod 48. The body 47 is pivotally attached to a bracket 38. The bracket 38 is rigidly attached to the mast 18. The bracket 38 could alternatively be attached to the base assembly 12.

The present invention also has an extension rod 49 attached at one end to piston rod 48 and rotatably attached to the boom 24 at its other end. The extension rod 49 is attached to boom 24 by rod pivot bolt 34 which passes through extension rod 49 and boom bracket 36.

The piston end of cylinder 46 is hydraulically attached to a fluid pump 54 through pressure hydraulic lines 51 and 51(a). The opposite end of cylinder 46 is attached to the reservoir through relief hydraulic line 53. The relief valve 52 in the pressure line can also directly vent pressure from pressure line 51 to relief line 53 through relief line 53(a), bypassing cylinder 46.

The pressure output by the pump 54 can be adjusted upwardly or downwardly by turning control valve 59.

The fluid in reservoir 50 is pressurized by activating a motorized pump 54.

Power to the apparatus is provided through power cord 57.

A pressure gauge 58, calibrated in pounds is attached to the pressure line 51 and is visible to a user.

While the preferred embodiment uses a hydraulic cylinder 46, other alternative methods, such as pneumatic cylinders or combination air/oil cylinders could also be used.

Figure 9:
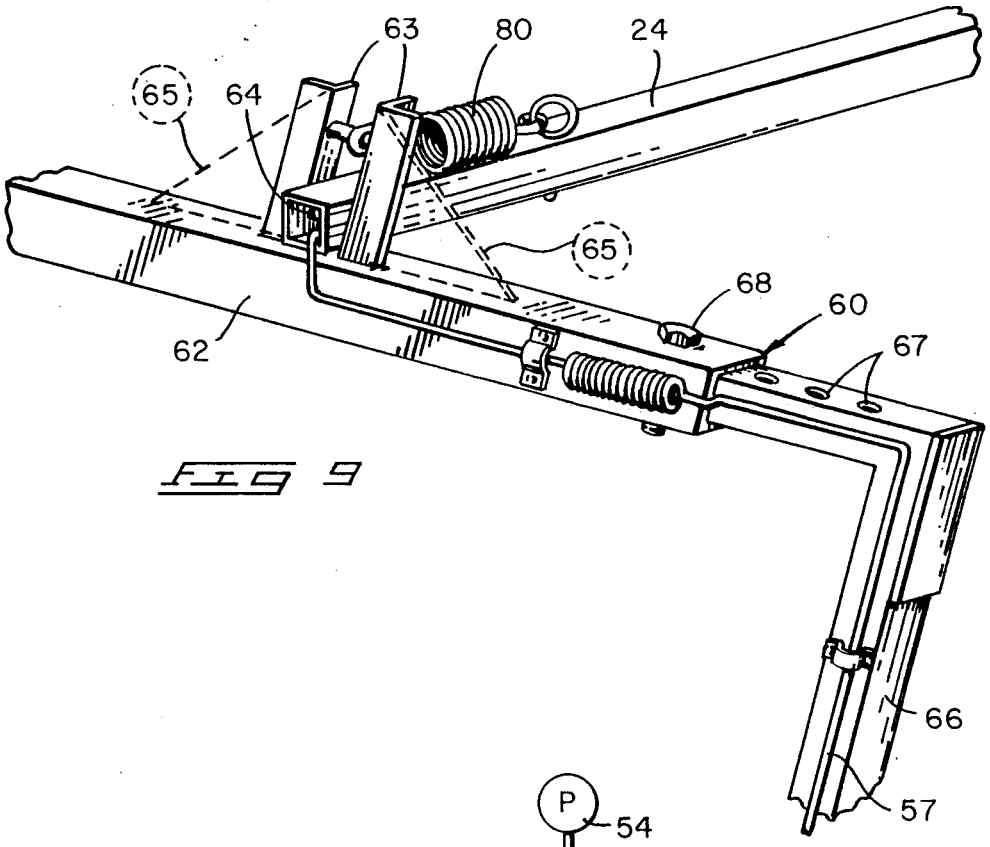
FIG. 9 is a partial isometric view of the boom assembly and handle assembly.

A handle assembly 60 is attached to one end of boom 24, as shown in Figs, 1 and 2. In the preferred embodiment, assembly 60 has a hollow cross bar 62. Two mounting members 63 extend from cross bar 62 and are positioned on either side of boom 24. A support bolt 64 extends through mounting members 63 and pivot arm 24. The mounting members 63 can pivot about support bolt 64, allowing the handle assembly 60 to pivot with respect to boom 24. As shown in FIGS. 2 and 9, reinforcing gussets 65 can be attached to mounting members 63 and the cross bar 62. Gussets 65 increase the weight which can be lifted without damage to the machine.

In the preferred embodiment, as shown in FIG. 9, the end of boom 24 limits the pivoting motion of cross bar 62. the top of cross bar 62 makes contact with boom 24 as handle bars 66 rotate away from mast 18. The handle bars are approximately perpendicular to the base when boom 24 is in its lowest position. The invention can alternatively be designed so the cross bar 62 does not contact the end of boom 24 when it rotates.

The handle assembly 60 also has a pair of opposed "L" shaped handle bars 66 which are slidably engaged into the ends of cross bar 62. As shown in FIG. 2, the handle bars 66 have a series of adjustment holes 67. Locking pins 68 extend through holes (not shown) in cross bar 62 and through adjustment holes 67 to lock handle bars 66 in position with respect to cross bar 62.

As shown in FIG. 2, a pair of lift grips 69 are attached to each of the handle bars 66. The position of lift grips 69 can be adjusted by inserting them through different lift adjustment holes 70.

In the preferred embodiment a pressure actuated normally open switch 71 is enclosed in lift grip 69. The switch 71 is closed when a user grasps the lift grips 69. The switch 71 is in the electrical circuit by way of motor contactor relay (not shown) between on off switch 56 and pump 54.

A biasing spring 80 is attached between the ends of mounting members 63 and boom 24, as shown in FIGS. 1, 3, or 9. The biasing spring 80 holds the handle assembly 60 in position shown in FIG. 1 when the apparatus is not in use.

As shown in FIG. 1, the mast 18 has stop holes 74 adjacent its upper end. A rod (not shown) can be inserted through one of the holes so that pivot arms 22 will contact it and stop their rotation. This is to prevent the boom 24 from rotating too far and damaging the ceiling.

The preferred embodiment also has a bench assembly 83. the bench assembly 83 has a pair of support legs 84 rigidly attached to and extending upwardly from, the base member 14. A rigid bench support member 85 is attached between support legs 84 and mast 18. A bench 88 is attached to bench support member 85 as shown in FIG. 1.

As shown in FIGS. 1 and 2, the preferred embodiment also has a resistance machine assembly 90. The resistance machine assembly 90 has a pair of longitudinal resistance arms 92. The resistance arms 92 are parallel, and are pivotally mounted to a resistance bench support member 96, as shown in FIG. 1.

The resistance support member 96 is a rigid longitudinal member having one end slidably inserted into bench support member 85. A bolt 97 inserted through resistance support member 96 and bench support member 85 locks it in position.

The resistance arms 92 are attached to resistance support member 96 with resistance arm pivot 94, which extends through resistance arms 92 and the resistance arm bracket 95. The resistance arm bracket 95 is rigidly attached to resistance support member 96.

Figure 6:
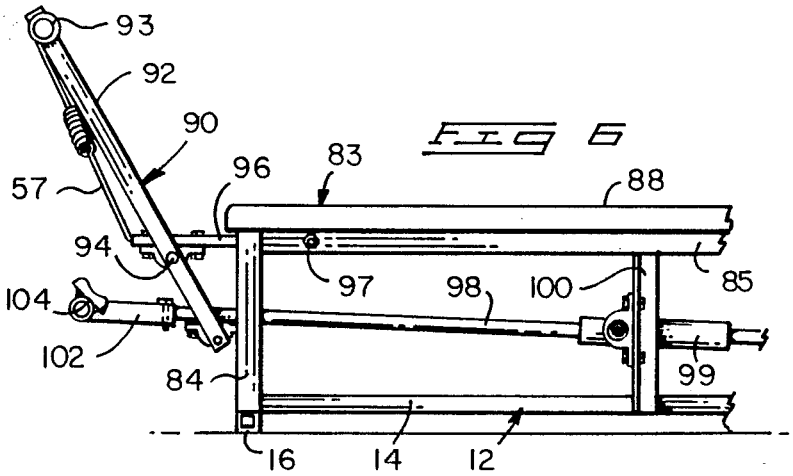
FIG. 6 is a partial side elevational view of the invention showing a portion of the exercising machine it a second position.
Figure 5:
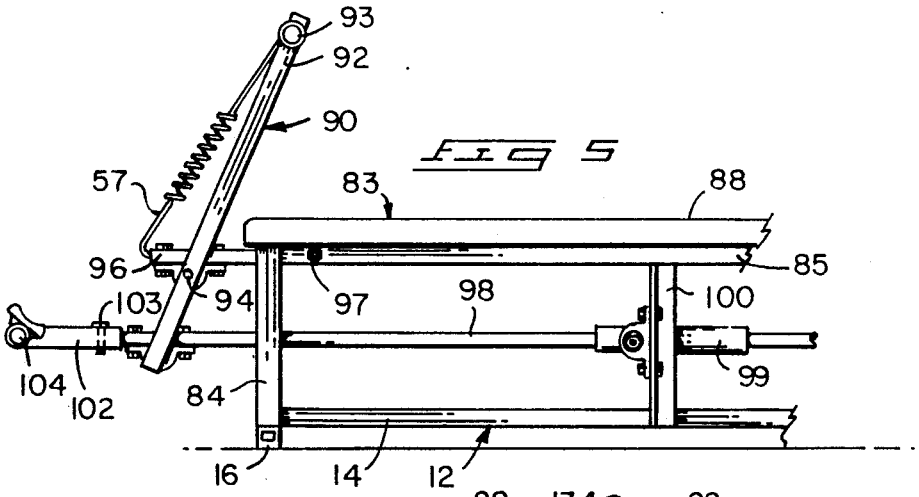
FIG. 5 is a partial side elevational view of the invention showing a portion of the exercising machine in a first position.
Figure 4:
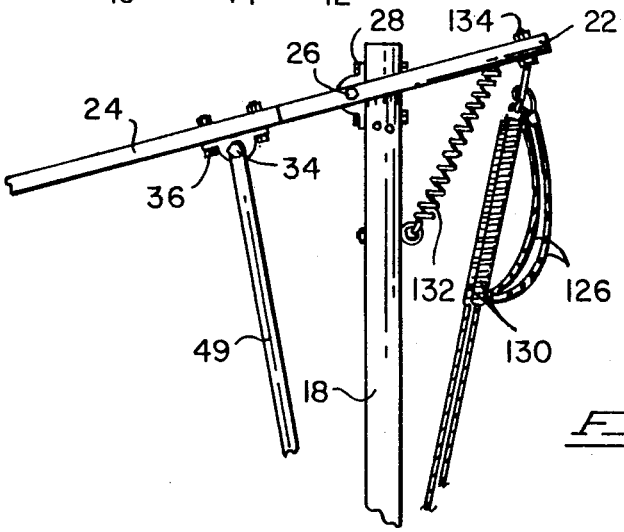
FIG. 4 is a partial side elevational view of the invention showing the boom assembly and mast.

A pull shaft 98 is pivotally attached between the lower ends of resistance arms 92. The pull shaft 98 extends from the resistance arms 92 toward the mast 18. As shown in Figs. 1, 5 and 6, a pull shaft carrier 99 is pivotally attached to a middle support leg 100. The middle support leg 100 extends between the base member 14 and the bench support member 85. The pull shaft 98 is slidably inserted through pull shaft carrier 99.

A pair of resistance grips 93 are attached to and extend outwardly from the upper end of resistance arms 92 and are adapted to be grasped by a user. One of the resistance grips 93 contains a normally open pressure switch identical to switch 71, which is connected in parallel with the switch in lift grip 69.

Attached to the end of pull shaft 98 is a foot rest extender 102. The foot rest extender has adjustment holes and an adjustment bolt 103, shown in phantom in FIGS. 1 and 5. Attached to and extending outwardly from the foot rest extender 102 are a pair of foot rests 104.

As shown in FIG. 1, a pair of cables 126 are removably attached to one end of the pull shaft 98. The cables 126 extend from pull shaft 98 around two pulleys 127. The pulleys 127 are rotatably mounted to opposite sides of mast 18. The cables 126 extend from pulleys 127, and are attached to the ends of pivot arms 24. In the preferred embodiment, tension springs 130 are attached between cables 126 and pivot arms 24. This maintains tension in cables 126 when the resistance machine assembly 90 is not being used, to retain cables 126 on pulleys 127.

The slack in cables 126 allows the user to raise and lower boom assembly 20 with the handle assembly 60 without causing resistance machine 90 to move.

The user may remove the entire resistance machine assembly 90 by removing connecting bolt 97 and cable bolt 134. The entire resistance machine assembly 90 may then be removed from the apparatus.

To use the apparatus, the user would first plug power cord 57 into a suitable outlet and turn on switch 56, providing power to the pressure switches 71 in lift grips 69 and resistance grips 93. The control valve 59 would be adjusted to provide the desired pressure in the hydraulic system.

If the user desires to use the weight lifting feature, he would sit or lie on bench 88 and grasp lift grips 69. Grasping lift grips 69 closes the switch 71 in grip 69 and applies power to the pump 54, pressurizing the hydraulic system.

Pressurizing the hydraulic system with the relief valve closed actuates the cylinder 46, which is connected in a pull mode. This pulls the piston toward the bracket 38, which results in a downward force on boom 24. In order to push the lift grips 69 in an upward direction, the user must overcome the pulling pressure of piston rod 48.

When the user's arms have reached their upper extension, the continuous downward pressure on the piston rod 48 results in a pulling action on boom 24, just as though the user had a free weight suspended overhead.

There are two purposes for allowing the handle assembly 60 to pivot. First, when the boom 24 is raised, it makes an arc, with the end of boom 24 moving away from mast 18 until it is perpendicular to mast 18, when it moves toward mast 18. Since the handle assembly 60 rotates, the user can maintain the lift grips 69 directly above him.

The second reason is that the pivoting motion of handle assembly 60 gives the user the "feel" that he is lifting free weights. It appears to the user that the weight can shift back and forth as he lifts it.

If the user becomes fatigued and can no longer maintain upward pressure on lift grips 69 he may simply release the lift grips 69, which opens the switch 71. This immediately turns off pump 54, and the pressure on piston rod 48 ceases. The boom 24 will simply stay in the same position, held in place by counterbalancing spring 132 and cylinder 46.

If the user desires to use the resistance machine assembly 90, he would grasp resistance grips 93. Grasping resistance grips 93 would close the electrical circuit to pump 54, again pressurizing the hydraulic system and causing a pulling pressure on piston rod 48.

The operation of the resistance arms 92 and the pull shaft 98 are shown in FIGS. 5 and 6. FIG. 6 shows the resistance arms 92 in their normal position when the machine is not in use. In FIG. 5, the resistance arms 92 have been rotated toward mast 18, moving pull shaft 98 away from mast 18. This rotates boom assembly 20 against the pressure exerted by piston rod 48.

If the user releases resistance grips 93, the electrical circuit to pump 54 is broken, which removes the pressure on piston rod 48.

By rotating the resistance grips 93 toward the mast 18, the pull shaft 98 will move outwardly from mast 18, pulling on cables 126. This creates a downward force on the ends of pivot arms 24, which in turn applies upward pressure on boom 24. In order to move the resistance grips 93 in this direction, the user must again counteract the pressure exerted by piston rod 48.

Continuous pressure is applied against the user as the resistance grips 93 are moved relative to mast 18.

While in the preferred embodiment as shown, the cylinder 46 is operated in a single action pull mode, it could also be operated in a dual action mode, or in a single action push mode.

The handle assembly 60 could also be removed and apparatus adaptable to be lifted by a person's shoulders could be substituted. The shape of boom 24 could be changed so the user could do "clean and jerk" exercises.

In compliance with the statute, the invention has been described in language more or less specific as to structural features. It is to be understood however, that the invention is not limited to the specific features shown, since the means and construction herein disclosed comprise a preferred form of putting the invention into effect. The invention is therefore, claimed in any of its forms or modifications within the proper scope of the appended claims, appropriately interpreted in accordance with the doctrine of equivalents.

I claim:

1. An apparatus for exercising, comprising:

an elongated base having opposed ends and a bench attached thereto spacedly above the base;

an elongate upright mast having an upper end and a lower end, said mast being rigidly attached to the base;

a longitudinal boom assembly having opposed first and second ends, the boom assembly being pivotally attached intermediate its ends to the mast, adjacent the upper end of the mast, and the boom assembly being capable of pivotable movement about an axis perpendicular to the elongate axis of the mast;

adjustable pressure means having a first end pivotally attached to the boom intermediate the boom first end and its attachment to the mast and a second end pivotally attached to the base, the pressure means being adapted to apply a continuous force on the boom;

handle means attached to the first end of the boom assembly, the handle means adapted to be grasped by a user for imparting pivotal movement to the boom assembly;

a longitudinal pull shaft carrier pivotally mounted to a carrier support rigidly attached to the base, the pull shaft carrier defining a medial channel therethrough;

a pull shaft with opposed first and second ends slidably carried in the medial channel defined in the pull shaft carrier;

an arm assembly pivotally attached to the base and to the second end of the pull shaft to impart reciprocating movement to the shaft responsive to pivotal motion of the arm assembly; and cable means attached between the first end of the pull shaft and the second end of the boom to pivot the boom assembly when the pull shaft is moved away from the mast.

2. The apparatus of claim 1, further comprising:

switch means carried by the handle means and operatively connected to the pressure means for activating and deactivating the pressure means.

3. The Apparatus of claim 1, further comprising:

spring means attached between the mast and the second end of the boom assembly for counter balancing the first end of the boom assembly to a predetermined position when the pressure means is deactivated.

4. The apparatus of claim 1, further comprising:

control means attached to the base assembly for adjusting the pressure means.

5. The apparatus of claim 1, wherein the adjustable pressure means is a hydraulic cylinder having a body and a movable piston and further including electrically powered pump means attached to the cylinder for operating the cylinder.

6. The apparatus of claim 1, further comprising:

switch means attached to the handle assembly for activating and deactivating the electrically powered pump means.

7. The apparatus of claim 1, further comprising:

stop means carried by the upper end portion of the mast for preventing the boom assembly from pivoting past a predetermined position away from the base.

8. A resistance exercise machine, comprising:

a base for support on an underlying supportative surface;

an upright mast with an upper and a lower end, the lower end being rigidly attached to the base;

an elongate boom assembly having first and second ends, the boom assembly being pivotally attached intermediate its ends to the mast adjacent the mast's upper end portion;

a hydraulic cylinder, having an outer body and a piston, pivotally communicating between the boom assembly and the base;

pump means attached to the cylinder for applying hydraulic pressure to the piston to move it into the body;

an upright carrier support rigidly attached to and extending upwardly from the base;

a longitudinal pull shaft carrier pivotally mounted to the carrier support, the pull shaft carrier having a longitudinal channel therethrough;

a pull shaft, with opposed first and second end, slidably carried in the longitudinal channel defined through the pull shaft carrier;

an arm assembly pivotally attached to the base and to the second end of the pull shaft, the arm assembly being pivotable for imparting reciprocating movement to the pull shaft; and cable means attached between the first end of the pull shaft and the second end of the boom assembly for rotating the boom assembly when the pull shaft is moved away from the mast.

* * * * *